US008740634B2

(12) United States Patent
Uesaka et al.

(10) Patent No.: US 8,740,634 B2
(45) Date of Patent: Jun. 3, 2014

(54) CARD CONNECTOR

(75) Inventors: Ryo Uesaka, Kanagawa (JP); Masamitsu Takasaki, Kanagawa (JP); Masanori Hayashi, Kanagawa (JP); Yuji Naito, Kanagawa (JP); Mitsuhiro Tomita, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 148 days.

(21) Appl. No.: 13/529,038

(22) Filed: Jun. 21, 2012

(65) Prior Publication Data

US 2012/0329330 A1 Dec. 27, 2012

(30) Foreign Application Priority Data

Jun. 21, 2011 (JP) ..... 2011-137659

(51) Int. Cl.
*H01R 13/62* (2006.01)

(52) U.S. Cl.
USPC ..... 439/159

(58) Field of Classification Search
USPC ..... 439/159, 157, 152–155, 160, 630
See application file for complete search history.

(56) References Cited

U.S. PATENT DOCUMENTS

| | | | | |
|---|---|---|---|---|
| 7,198,498 | B2 * | 4/2007 | Miyamoto | 439/159 |
| 7,309,258 | B2 * | 12/2007 | Anzai et al. | 439/630 |
| 7,377,814 | B2 * | 5/2008 | Shen et al. | 439/630 |
| 7,435,117 | B2 * | 10/2008 | Ma | 439/188 |
| 7,510,415 | B2 * | 3/2009 | Wang | 439/159 |
| 7,670,187 | B2 * | 3/2010 | Ting | 439/630 |
| 2012/0329330 | A1 * | 12/2012 | Uesaka et al. | 439/630 |
| 2013/0012070 | A1 * | 1/2013 | Uesaka et al. | 439/629 |

* cited by examiner

*Primary Examiner* — Neil Abrams
*Assistant Examiner* — Phuongchi T Nguyen
(74) *Attorney, Agent, or Firm* — Timothy M. Morella

(57) ABSTRACT

A rear side connection terminal arranged along the back end edge of a housing is provided with a base part in which at least a portion is embedded in a bottom wall part of the housing, a contact arm part in a cantilever shape in which a tip end extends slanted upwards towards a front end of the housing, a contact part that is connected to a tip end of the contact arm part and that contacts with a terminal member of the card, and a contact arm support part that includes a curved part that projects rearward with a bottom side front end coupled to a back end of the base part and a top side front end coupled to a back end of the contact arm part.

17 Claims, 8 Drawing Sheets

CARD CONNECTOR

REFERENCE TO RELATED APPLICATIONS

The Present Disclosure claims priority to prior-filed Japanese Patent Application No. 2011-137659, entitled "Card Connector," filed on 21 Jun. 2011 with the Japanese Patent Office. The content of the aforementioned patent application is incorporated in its entirety herein.

BACKGROUND OF THE PRESENT DISCLOSURE

The Present Disclosure relates, generally, to a card connector, and, more particularly, to a card connector having high reliability that can arrange the contact part of the tip end of the contact arm to be positioned near the back end edge of the housing while maintaining a sufficient length in spring length for the connection terminal, allowing a card having terminal members arranged on the back end side to be easily inserted and ejected.

Conventional electronic devices have been provided with a card connector to use various types of memory cards. An example is disclosed in Japanese Patent Application No. 2002-159034. The content of the aforementioned patent application is incorporated in its entirety herein.

FIG. 8 illustrates a conventional card connector. In the drawing, 811 is a housing of a card connector made from an insulating material such as a synthetic resin, and a bottom plate 811*b* and pair of side plates 811*c* are provided, and a substantially rectangular plate shaped memory card 901 is housed. The memory card 901 is, for example, a SIM card having an electrode pad not shown exposed to the bottom surface 901*a*.

Further, a plurality of terminal retention parts 811*e* are formed on the bottom panel part 811*b*, and the terminals 851 made of metal are housed and held within each terminal retention part 811*e*. In the example illustrated in the figure, a total of six terminals 851 are arranged so as to be lined up in 2 lines so as to align with the arrangement of electrodes of a SIM card. Further, the terminals 851 are soldered to connection pads on the surface of a circuit board not illustrated for conductivity with a conductive trace on the circuit board. Also, the housing 811 is fixed to the surface of the circuit board by soldering the electrodes to a connection pad.

In addition, tabs 861 made of metal are attached to each of the side panel parts 811*c*. The tabs 861 are provided with support tabs 862 having a plate shape that extend vertically parallel, and the support tabs 862 are attached so as to interpose the side panel part 811*c* from the top and bottom. Additionally, the housing 811 is fixed to the surface of the circuit board for further reinforcement by the support tabs 862 on the bottom side being soldered to anchoring pads formed on the surface of the circuit board.

Further, when mounting the memory card 901 into the housing 811, the memory card 901 is inserted so that the support tab 862 of the tab 861 push opens from an upward slant of the housing 811. In this manner, the inserted memory card 901 is held by the support tab 862 on the top side. Further, each of the electrode pads that are exposed on the bottom surface 901*a* of the memory card 901 conduct by contacting with a corresponding terminal 851.

However, there is poor usability in the conventional card connector because loading and ejecting the memory card 901 is difficult. Therefore, card connectors that have a push/push type guide mechanism that operate by pressing on the card are becoming more common for both loading and ejecting the card so that a user can load and eject a card easily with one hand.

However, in recent years, in conjunction with the miniaturization of electronic devices, there have also been advancements in the miniaturization of cards used by electronic devices. Further, miniaturizing cards increases the area ratio of the electrode pads relative to the surface of the card which reduces the available coverage for arranging electrode pads. Therefore, for cards that have two rows of electrode pads such as a SIM card, for example, the front row and back row of electrode pads are arranged respectively in positions near the front end and back end of the card. By doing this, with the card connector having a push/push type card guide mechanism, because the configuration is made for the card to be inserted into the card connector from an insertion opening, the tip end part of the contact arm of terminals corresponding to electrode pads arranged near the back end of the card must be arranged in a position near the insertion opening of the back end of the card connector.

Therefore, there is a risk of the contact arm of the terminal buckling due to contact with the card after being inserted from the insertion opening of the card connector and traveling inward when terminals are attached so that the cantilever shaped contact arm that exerts bias extends at a slant upwards toward the insertion opening from the interior of the card connector so that the tip end part is as close as possible to the insertion opening. Although the fear of the contact arm buckling is reasonably alleviated when attaching terminals so that the cantilever shaped contact arm extends at a slant upwards toward the interior from the insertion opening of the card connector, making the contact part of the tip end of the contact arm to be near to the insertion opening shortens the contact arm thereby shortening the spring length which makes contact between the tip end part and the electrode pads of the card to becomes less accurate.

SUMMARY OF THE PRESENT DISCLOSURE

An object of the Present Disclosure in resolving the problems of the conventional card connector is to provide a card connector having high reliability that can arrange the contact part of the tip end of the contact arm to be positioned near the back end edge of the housing while maintaining a sufficient length in spring length for the connection terminal, and that can allow a card having terminal members arranged on the back end side to be easily inserted and ejected.

Therefore, a card connector of the Present Disclosure, includes: a housing that houses a card provided with a terminal member; a connecting terminal attached to the housing that connects with the terminal member of the card; a cover member attached to the housing and which covers at least the housing and a portion of the card inserted in the housing; wherein the connection terminal includes a rear side connection terminal arranged along the back end edge of the housing; and the rear side connection terminal is provided with a base part in which at least a portion is embedded in a bottom wall part of the housing, a contact arm part in a cantilever shape in which a tip end extends slanted upwards towards a front end edge of the housing, a contact part that is connected to a tip end of the contact arm part and that contacts with a terminal member of the card, and a contact arm support part that includes a curved part that projects rearward with a bottom side front end coupled to a back end of the base part and a top side front end coupled to a back end of the contact arm part.

In another card connector of the Present Disclosure, the housing is further provided with a terminal holding recessed part that is arranged along the back end edge and passes through the bottom panel part, and the rear side connection terminal is held within the terminal holding recessed part so that the contact arm part, contact part, and contact arm support part do not abut against the bottom panel part.

In still another card connector of the Present Disclosure, the rear side connection terminal is provided with an opening formed in the base part; the base part is divided by the opening into a left and right pair of band parts that extend in the front and rear direction; the front end of the band parts is coupled by an embedded bar part in which at least a portion is embedded in the bottom panel part; and the contact part is positioned above the opening part.

In still another card connector of the Present Disclosure, the base part includes a folded part formed on the band part, and the back end of the base part is positioned lower than the embedded bar part.

In still another card connector of the Present Disclosure, a coupled belt part that couples the base part and contact arm support part is elastically formed, and the entire contact arm support part is slanted relative to the base part.

According to the Present Disclosure, the card connector can have a high reliability, can arrange the contact part of the tip end of the contact arm to be positioned near the back end edge of the housing while maintaining a sufficient length in spring length for the connection terminal, and can allow a card having terminal members arranged on the back end side to be easily inserted and ejected.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
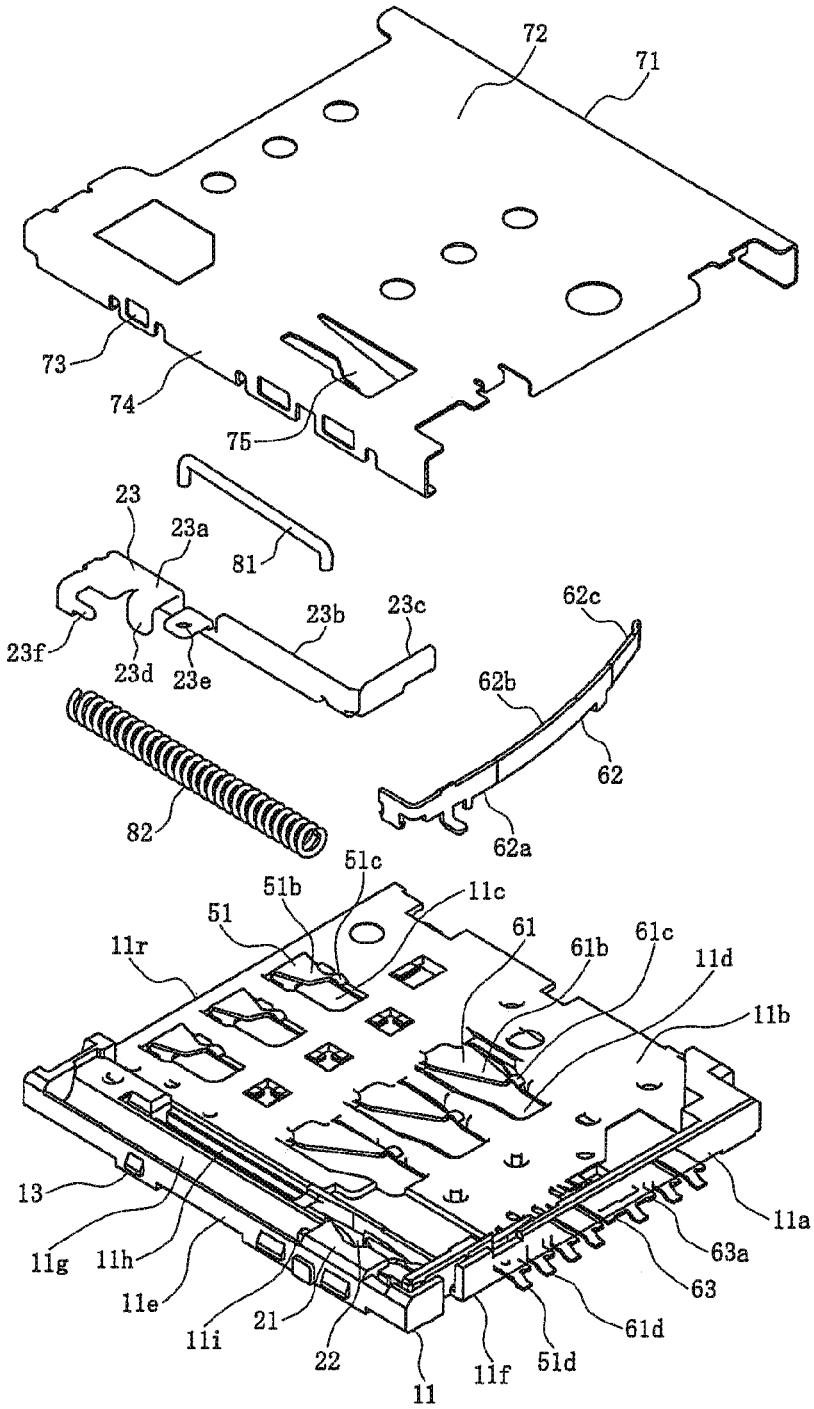
FIG. 1 is an exploded view of a card connector according to the Present Disclosure.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

In the drawings, 1 is a card connector according to the present embodiment that attaches to an electronic device not illustrated. The card 101 is inserted into the card connector, and the card 101 is loaded into the electronic device through the card connector 1. In addition, the electronic device may be any type of device such as a personal computer, cellular phone, PDA, digital camera, video camera, music player, game console, mobile navigation system, or the like.

Further, the card 101 is a memory card such as a SIM card, MMC®, SD® card, miniSD® card, xD picture Card®, memory Stick®, memory stick Duo®, smart Media®, Trans-Flash® memory card, and the like, and may be any kind of card, however, the description given in this embodiment is a micro SIM card.

Figure 4B:
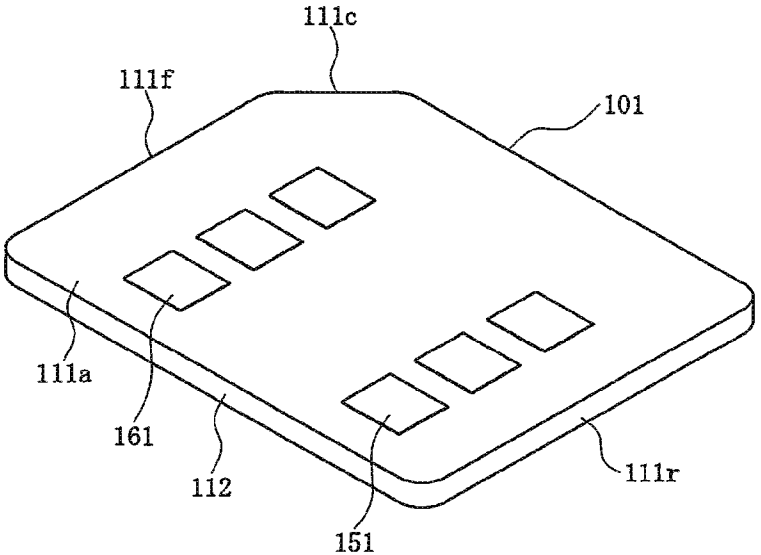
FIG. 4 is a perspective view of a card inserted in the card connector of FIG. 1, where (a) is a diagonal view from above and (b) is a diagonal view from below.
Figure 4A:
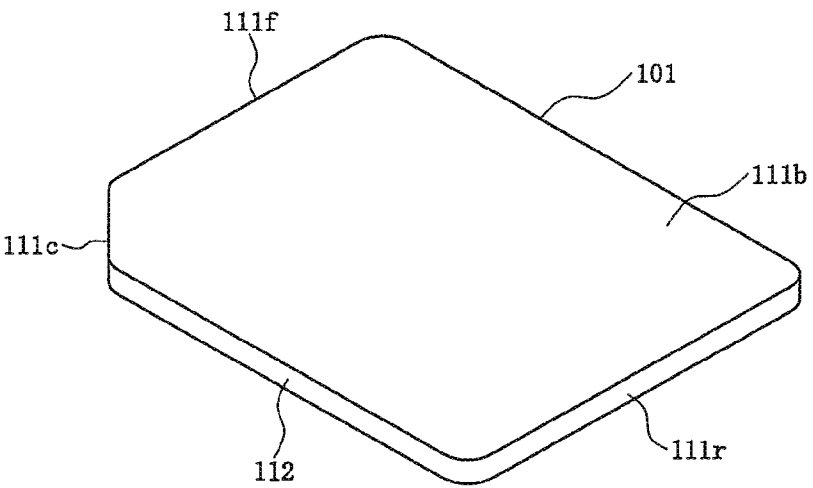

In the present embodiment, the card 101 has a nearly rectangular plate shape overall as illustrated in FIG. 4, and front side contact pads 161 are arranged in plurality as electrode pads, which are terminal members, so as to be in line along a front end 111*f* on a bottom surface 111*a* portion near the front end 111*f*. Also, rear side contact pads 151 are arranged in plurality as electrode pads, which are terminal members, so as to be in line along a back end 111*r* on a bottom surface 111*a* portion near a back end 111*r*. In other words, the electrode pads are arranged to be in two lines that extend in the width direction of the card 101, and of that, the line on the front end 111*f* side is made of the front side contact pads 161 and the line on the back end 111*r* side is made up the rear side contact pads 151. Note that neither the front side contact pads 161 nor the rear side contact pads 151 are arranged on the top surface 111*b*. In addition, a notch 111*c* with a slant cut out is formed on one corner, specifically the front left corner on the top surface 111*b*, where both left and right ends of the front end 111*f* and the side edge 112 join.

Here, the card connector 1 is provided with a housing 11 that is formed integrally composed of an insulating material of synthetic resin, or the like, and a shell 71 as a cover member attached to the upper side of the housing 11 and that is formed integrally by stamping a plate material composed of a conductive material such as metal or the like and undergoing a process for folding or the like. The shell 71 covers the housing 11 and the upper side of at least one part of the card 101 inserted in the housing 11. Further, the card connector 1 is roughly a flat rectangular parallelepiped shape that attaches to an electronic device, and the card 101 is inserted into the housing 11 from a rearward insertion opening 18 (upper left direction in FIG. 2). Specifically, the card 101 is inserted into a space formed between the housing 11 and the shell 71.

As shown in the drawings, the housing 11 has a bottom wall part 11*b* which is a substantially rectangular plate-like member and back wall part 11*a* that is installed from the bottom wall part 11*b*, and that extends along the forward edge part in the insertion direction of the card 100 and the housing 11, in other words the front end edge 11*f*.

Here, the bottom wall part 11*b* is provided with a rear side terminal holding recessed part 11*c* as a terminal holding recessed part that holds the rear side terminals 51 as rear side connection terminals arranged on the rear side of the connection terminals, and with a front side terminal holding recessed part lid as a terminal holding recessed part that holds the front side terminals 61 as front side connection terminals arranged on the front side of the connection terminals. The rear side terminal holding recessed part 11*c* is an opening which the bottom wall part 11*b* passes through in the plate thickness direction, and is arranged in a row so as to form a line that extends in the width direction of the housing 11 along the rearward edge part, which is to say the back end edge 11*r*, in the insertion direction of the card 101 in the housing 11. Further, the rear side terminals 51 are housed and held in each rear side terminal holding recessed part 11*c*. Further, the front side terminal holding recessed part lid is an opening which the bottom wall part 11*b* passes through in the plate thickness direction, and is arranged in a row so as to form a line that extends in the width direction of the housing 11 in between the front end edge 11*f* and the back end edge 11*r* of the housing 11. Further, the front side terminals 61 are housed and held in each front side terminal holding recessed part 11*d*.

The rear side terminals 51, wherein at least a portion of the base part 51*a* thereof, are embedded in the bottom wall part 11*b*, and the other part is exposed in the rear side terminal holding recessed part 11*c*. Specifically, the rear side terminals 51 are embedded and held in the bottom wall part 11*b* and at least a portion of the base part 51*a* is covered by an insulating material that configures the bottom wall part 11*b*, in other words, the housing 11 is formed by filling an insulating material into a cavity of a mold in which the rear side terminals 51 have been set therein in advance. Similarly, the front side terminals 61, wherein at least a portion of the base part 61*a* thereof, are also embedded in the bottom wall part 11*b*, and the other part is exposed in the front side terminal holding recessed part 11*d*. Specifically, the front side terminals 61 are embedded and held in the bottom wall part 11*b* and at least a portion of the base part 61*a* is covered by an insulating material that configures the bottom wall part 11*b*, in other words, the housing 11 is formed by filling an insulating material into a cavity of a mold in which the front side terminals 61 have been set therein in advance.

Figure 3:
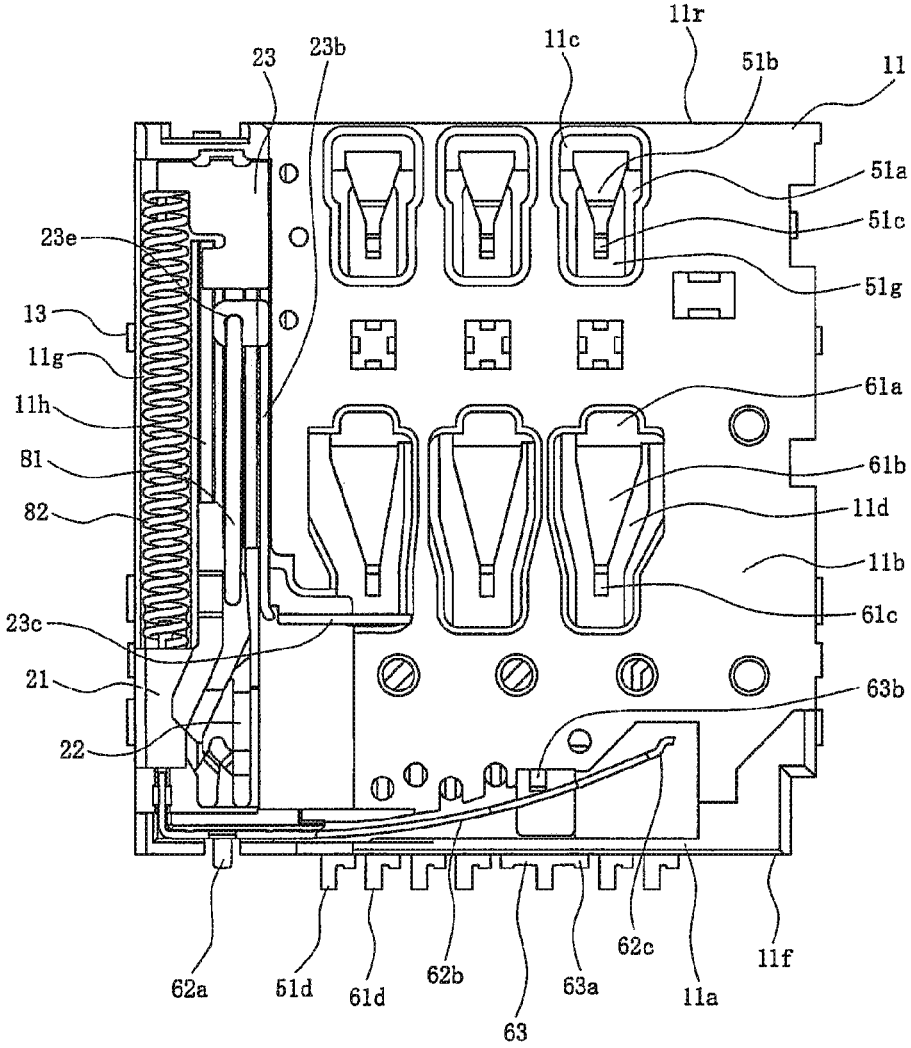
FIG. 3 is a plan view illustrating a state with the shell removed of the card connector of FIG. 1.

Further, the rear side terminals 51 are provided with a contact arm part 51*b* in a cantilever shape coupled by a tip end to the base part 51*a*, and with a contact part 51*c* connected to the free end, in other words the tip end, of the contact arm part 51*b*. The base end of the contact arm part 51*b* is positioned on the back end edge 11*r*, and the tip end thereof extends at a slant upward toward the front end edge 11*f*, and at least the top surface of the contact part 51*c* is positioned above the top surface of the bottom wall part 11*b* in a state in which the card in the card insertion space is in a non-inserted state. Note that the contact part 51*c* is provided with a curved side surface shape so as to extend facing upward, and the tip end thereof faces downward at a slant. As illustrated in FIG. 3, the contact arm part 51*b* and the contact part 51*c* are viewed from above and are positioned in the rear side terminal holding recessed part 11*c*.

Similarly, the front side terminals 61 are provided with a contact arm part 61*b* in a cantilever shape coupled by a tip end to the base part 61*a*, and with a contact part 61*c* connected to the free end, in other words the tip end, of the contact arm part 61*b*. The base end of the contact arm part 61*b* is positioned on the back end edge 11*r*, and the tip end thereof extends at a slant upward toward the front end edge 11*f*, and at least the top surface of the contact part 61*c* is positioned above the top surface of the bottom wall part 11*b* in a state in which the card in the card insertion space is in a non-inserted state. Note that the contact part 61*c* is provided with a curved side surface shape so as to extend facing upward, and the tip end thereof faces downward at a slant. As illustrated in FIG. 3, the contact arm part 61*b* and the contact part 61*c* are viewed from above and are positioned in the front side terminal holding recessed part 11*d*.

The rear side terminals 51 and the front side terminals 61 are arranged so that the contact part 51*c* and the contact part 61*c* contact each of the rear side contact pads 151 and the front side contact pads 161 of the card 101 held within the card connector 1. Accordingly, the configuration of the arrangement and number of rear side terminals 51 and front side terminals 61 can be appropriately modified in order to match the configuration of the arrangement and number of rear side contact pads 151 and front side contact pads 161 of the card 101. In the example illustrated in the figures, there are three each of the rear side terminals 51 and the front side terminals 61 and these are arranged in a rectangular lattice shape when viewed from above.

Additionally, one end of the coupling part in a long and thin band shape not illustrated is coupled to the base part 51*a* of the rear side terminals 51. The coupling part extends in the front and rear direction of the housing 11 and is embedded in the bottom wall part 11*b*. Further, a solder tail part 51*d* extends in the front direction from the other end of the coupling part and is exposed so as to project forward from the front end edge 11*f*. Further, the solder tail part 51*d* is electrically connected to a counter side terminal member such as a signal wire, contact pad, terminal, or the like that is formed on the circuit board or the like in the electronic device, by soldering or the like. Note that the coupling part of each rear side terminal 51 is arranged so as to reach the front end edge 11*f* by passing through a side of the front side terminal 61 arranged at the front.

Similarly, one end of the coupling part in a long and thin band shape not illustrated is also coupled to the base part 61*a* of the front side terminals 61. The coupling part extends in the front and rear direction of the housing 11 and is embedded in the bottom wall part 11*b*. Further, a solder tail part 61*d* extends in the front direction from the other end of the coupling part and is exposed so as to project forward from the front end edge 11*f*. Further, the solder tail part 61*d* is electrically connected to a counter side terminal member such as a signal wire, contact pad, terminal, or the like that is formed on the circuit board or the like in the electronic device, by soldering or the like.

Further, the housing really 11 has a sidewall part lie that extends in the front and rear direction along one of the side edges of the bottom wall part 11*b*. A card guide mechanism housing part 11*h*, a slide can part 21, and a biasing member housing part 11*g* are formed on the inner side of the side wall part lie. Further, a sliding member 23 of the card guide mechanism for guiding the card 101 inserted into the card connector 1, is attached with the ability to slide in the front and rear direction on the card guide mechanism housing part 11*h*. In addition, the slide can part 21 is a member that functions as a sliding cam only cam mechanism of a heart shaped cam for performing the push/push type operation, and a cam groove 22 is formed on the top surface thereof. Furthermore, a biasing member 82 is housed in the biasing member housing part 11*g* as a coil spring that exerts a biasing force when in a compressed state. Note that the back end surface of the slide can part 21 functions as a biasing force receiving part that receives the biasing force of the biasing member 82, and a locking projection 111 that locks the biasing member 82 is formed, and one end of the biasing member 82 is attached.

The sliding member 23 is provided with a card holding part 23*a* for holding the card 101, a guide part 23*d* that slides within a groove shaped card guide mechanism housing part 11*h*, a cam engagement part 23*e* in which one end engages the other end of a long and thin pin member 81 as a cam member that engages with the cam groove 22, and a locking projection 23*f* that locks one end of the biasing member 82. By this, the sliding member 23 is biased in the direction that is opposite to the insertion direction of the card 101, in other words, in the ejection direction of the card 101. Note that the card holding part 23*a* includes a long and thin band shaped side edge holding part 23*b* that extends toward the front, and a long and thin band shaped front end holding part 23*c* that is coupled to the tip end of the side edge holding part 23*b* and extends in the width direction of the housing 11. Further, the sliding member 23 travels in the front and rear direction together with the card 101 and holds the card 101 by the side edge holding part 23*b* and the front end holding part 23*c* of the card holding part 23*a*.

This type of card connector 1 that provides a card guide mechanism and requires an operation for pushing the card 101 when inserting the card 101 into the card connector 1 as well is when ejecting the card 101 from the card connector 1 is known as a so-called push-in and push-out type or a push/push type. This type of operation is similar to an alternate operation in the field of push button switches (position hold type, push on and push off type). The push/push operation is performed by pushing the slide member 23 the travels together with the card 101 by the joint movement of the pin member 81 and the cam groove 22. By this, the cam guide mechanism can eject the card 101 by moving in a direction opposite to the insertion direction from the end point by the biasing force of the biasing member 82 when the card 101 moves in the insertion direction and reaches the end point by a push operation in which the card 101 is pushed in the insertion direction. Also, the sliding member 23 stops in the locked position, and by this, the card 101 is held within the card connector 1.

The pin member 81 is held by being biased in the downward direction from above by the pin press member 75 of the shell 71. The pin press member 75 is a plate shaped member that provides bias by being formed in a folding process so as to enable a portion of the shell 71 to have push pressure in the direction of the bottom wall part 11*b* of the housing 11, and the pin member 81 is positioned between the pin press member 75 and the sliding member 23 or the housing 11, and is held such that it can be removed from the sliding member 23 or the housing 11.

Figure 2:
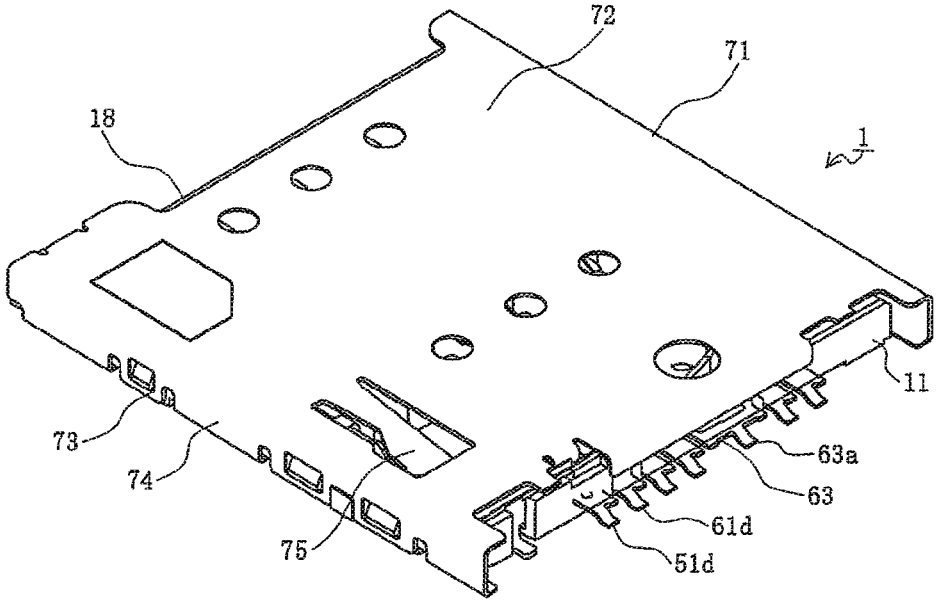
FIG. 2 is a perspective view illustrating the card connector of FIG. 1.

Further, the shell 71 has a top panel part 72 in substantially a rectangular shape, and a plurality of side panel parts 74 installed from a plurality of locations on the side edge of the top panel part 72. A plurality of latch openings 73 are formed on the side panel parts 74, as illustrated in FIG. 2, and when the shell 71 is attached to the upper side of the housing 11, the latch opening 73 latches to the latching projection 13 formed on the outer surface of the side wall part 11*e* of the housing 11 so that the shell 71 is fixed to the housing 11.

Further, a card detection switch is arranged near the front end edge 11*f* of the housing 11 that detects that the rear side contact pads 151 and the front side contact pads 161 of the card 101 are in contact with the rear side terminals 51 and the front side terminals 61, and that detects that the card 101 has been loaded into the card connector 1. The card detection switch is formed by a first contact point member 62 attached to the back wall part 11*a* or the vicinity thereof, and by a second contact point member 63 in which the majority is embedded in the bottom wall member 11*b*.

The first contact point member 62 includes an attaching member 62*a* attached to the back wall part 11*a*, a cantilever shaped main body part 62*b* in which the base end is attached to the attaching part 62*a* and which extends in the lateral direction, and an abutting part 62*c* that contacts the free end of the main body part 62*b*. Further, the attaching part 62*a* is substantially parallel to the side surface of the back wall part 11*a*, and the main body part 62*b* is slanted relative to the side surface of the back wall part 11*a* when the card 101 is not inserted in the card connector 1, and the abutting part 62*c* is arranged so as to protrude to face the front side in relation to the insertion direction of the card 101, which is to say facing rearward. Therefore, when the card 101 is inserted, the front end 111*f* of the card 101 abuts the abutting part 62*c*.

Meanwhile, the second contact point member 63 includes a flat plate like attaching part 63*a* embedded in an area near the back wall part 11*a* on the bottom wall part 11*b*, and a contact part 63*b* in which the base end is connected to the attaching part 63*a* and the tip end is exposed from the bottom wall part 11*b*.

Further, when the card 101 is not inserted, as illustrated in FIG. 3, the main body part 62*b* of the first contact point member 62 contacts with the contact part 63*b* of the second contact point member 63, and thus the first contact point member 62 contacts the second contact point member 63 making the card detection switch is a conductive state, which is to say, it turns on.

However, when the card 101 is inserted and arrives at the position where the rear side contact pads 151 and the front side contact pads 161 contact the rear side terminals 51 and the front side terminals 61, the abutting part 62*c* of the first contact point member 62 is pressed toward the direction of the back wall part 11*a* by the front end 111*f* of the card 101 and is displaced, and the main body part 62*b* of the first contact point member 62 separates from the contact part 63*b* of the second contact point member 63. By this, the first contact point member 62 is disconnected from the second contact point member 63 making the card detection switch to be in a nonconductive state, which is to say, it turns off.

Next, a detailed description will be given of the rear side terminals 51.

Figure 5B:
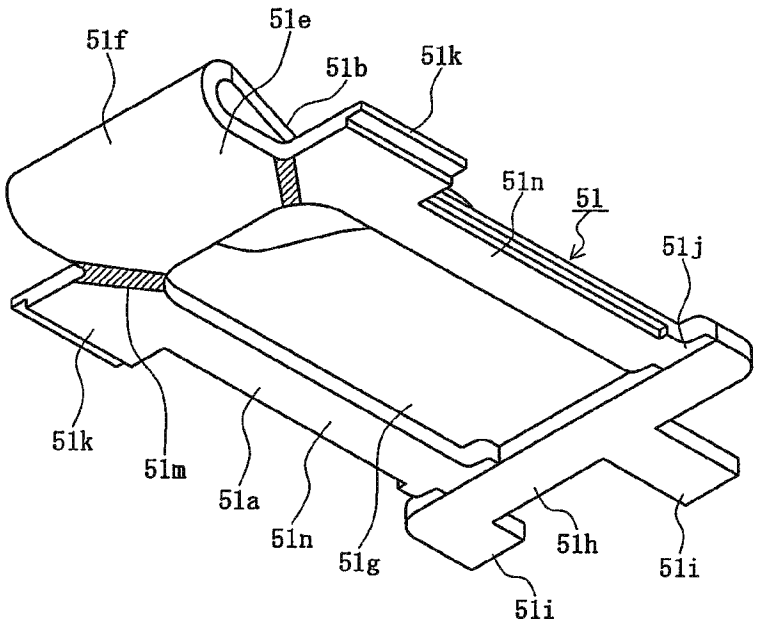
FIG. 5 is a perspective view of rear terminals of the card connector of FIG. 1, where (a) is a diagonal view from above and (b) is a diagonal view from below.
Figure 5A:
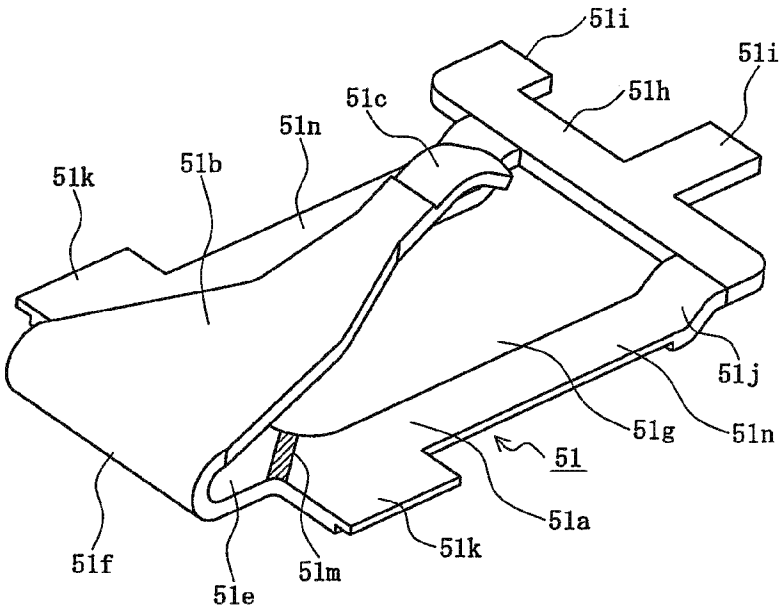

The rear side terminals 51 are integrally formed in a shape such as that illustrated in FIG. 5 by a machining tool such as, for example, a press device and undergoes a working process such as punching and folding of a plate material made of a conductive material such as metal. In this case, the punching and folding process may be performed simultaneously or may be performed sequentially. Note that the rear side terminals 51 may be formed by any type of working method, and may be formed by any working method such as, for example, laser processing, etching, and the like.

Figure 6A:
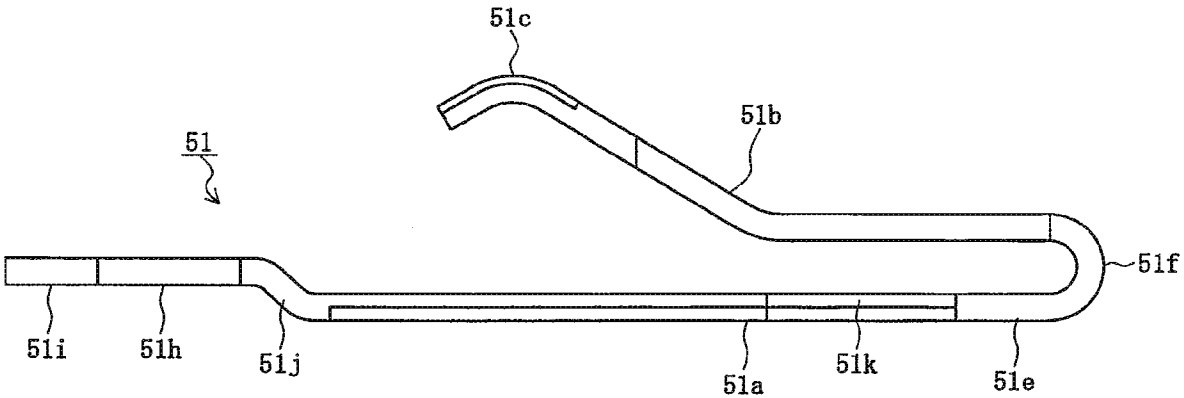
FIG. 6 is a lateral view of rear terminals of FIG. 5, where (a) is a view in which a card is not loaded and (b) is a view in which a card is loaded.
Figure 6B:
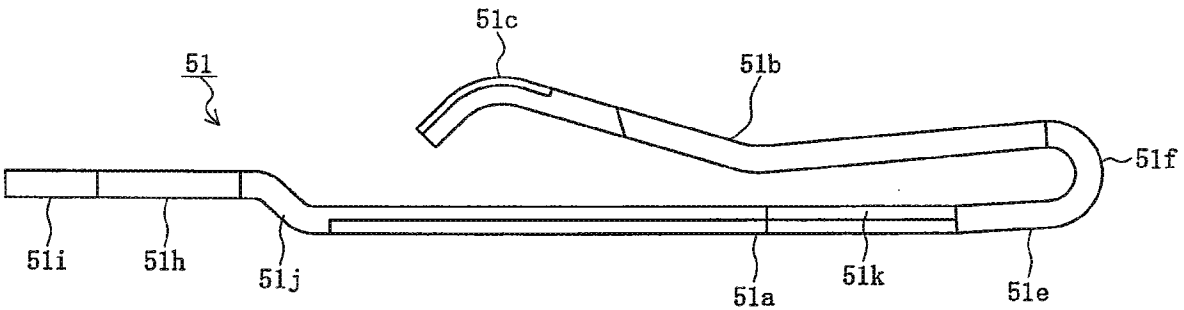

Note that the illustrations of the solder tail part 51*d* and the coupling parts that couple the solder tail part 51*d* with the base part 51*a* are omitted in FIGS. 5 and 6.

An opening 51*g* is formed in the center of the base part 51*a*, and by this, the base part 51*a* is divided into a pair of left and right band shaped parts 51*n* that extends in the front end rear direction. Further, the back ends of the left and right band shaped parts 51*n* of the base part 51*a* are coupled by a contact arm support part 51*e*, and the front ends are coupled by a band shaped embedded bar part 51*h*. The embedded bar part 51*h* is a member held by being embedded in the bottom wall part 11*b* by at least a part thereof, specifically, a part at least near the front end, is covered by an insulating material that forms the bottom wall part 11*b* by a so-called over-mold formation. Further, the opening 51*g* is an opening that is substantially rectangular and the periphery is demarcated by the contact arm support part 51*e* and the embedded bar part 51*h*.

The contact arm support part 51*e* includes a curved part 51*f* that is curved substantially 180 degrees to project rearward couples with the upper side and the lower side, and the back end of the contact arm part 51*b* is coupled to the upper side front end and the back end of the base part 51*a* is coupled to the lower side front end. By this, the side surface shape of the part that includes the base part 51*a*, the contact arm support part 51*e*, and the contact arm part 51*b* and the rear side terminal 51 becomes substantially U shaped, and the contact arm part 51*b* is positioned further above than the base part 51*a* and extends forward. Note that the contact arm part 51*b* has a wide width back end and is nearly equivalent to the upper side front end of the contact arm support part 51*e*, and has a narrow width tip end and has a substantially triangular plate like member shape when viewed from above.

In addition, a folded part 51*j* is formed near the front end of the left and right band shaped part 51*n* of the base part 51*a*, in other words, near the coupling part with the embedded bar part 51*h*. The portion rearward from the folded part 51*j* on the base part 51*a*, which is at least the back end of the base part 51*a*, is positioned lower than the embedded bar part 51*h* due to the folded part 51*j* as illustrated in FIG. H. By this, because the lower side front end of the contact arm support part 51*e* can be positioned near the bottom surface of the bottom wall part 11*b* even if the embedded bar part 51*h* is set up so as to be positioned in the middle of the thickness direction of the bottom wall part 11*b*, the height position of the contact arm part 51*b* from the bottom surface of the bottom wall part 11*b* can be suppressed even with a large curvature radius of the curved part 51*f* and a wide spacing between the lower side front end of the contact arm support part 51*e* and the upper side front end, thereby contributing to the low height of the card connector 1.

A forward raised part 51*i* that extends facing forward is connected to the front end of the embedded bar part 51*h*. In the example illustrated in the figure, there are two forward raised parts 51*i*, however, the number thereof may also be one or may also be three or more and the length and width thereof may be freely set, and furthermore, the arrangement thereof may also be freely set. Additionally, the back end of the coupling part is connected to the front end of either one of the forward raised parts 51*i*. By this, the solder tail part 51*d* conducts with the base part 51*a*.

In addition, a lateral raised part 51*k* that extends facing outward left and right is connected to the side end of the base part 51*a*. In the example illustrated in the figure, there is a lateral raised part 51*k* on both the left and right, however, the number thereof may also be two or more and the length and width thereof may be freely set, and furthermore, the arrangement thereof may also be freely set. Because the ratio of the portion embedded in the bottom wall part 11*b* is increased by the existence of the lateral raised part 51*k*, the integrity of the bottom wall part 11*b* is strengthened with a base part 51*a*.

As illustrated in FIG. 3, the portion near the side end in the left and right band shaped part 51*n* of the base part 51*a*, the majority of the embedded bar part 51*h*, the forward raised part 51*i*, and the lateral raised part 51*k* are embedded in the bottom wall part 11*b*, and the opening 51*g*, the contact arm support part 51*e* that includes the curved part 51*f*, the contact arm part 51*b*, and the contact part 51*c* are not embedded in the bottom wall part 11*b* and are exposed within the rear side terminal holding recessed part 11*c*. In other words, with the rear side terminals 51, the forward portion and both left and right side portions are embedded and fixed to the bottom wall part 11*b*, and the rearward portion is not embedded in the bottom wall part 11*b*, is not fixed, and does not abut.

By this, the contact arm support part 51*e* that includes the curved part 51*f*, the contact arm part 51*b*, and the contact part 51*c* are not constrained to the bottom wall part 11*b* and do not abut against the bottom wall part 11*b*, but can freely displace in the thickness direction of the bottom wall part 11*b*, which is to say, in the vertical direction. Accordingly, because the contact part 51*c* can be flexibly displaced across a wide range in the vertical direction, a contact state with the rear side contact pads 151 of the inserted card 101 can be securely maintained.

In addition, because the rearward portion of the rear side terminals 51 do not need to be embedded and fixed to the bottom wall part 11*b*, the rear side terminal holding recessed part 11*c* is formed so as to be near the back end edge 11*r* of the housing 11, and the rear side terminals 51 can be arranged in a position adjacent to the back end edge 11*r*. Accordingly, the distance from the back end edge 11*r* to the contact part 51*c* can be shortened, and even if the distance from the back end 111*r* of the card 101 to the rear side contact pads 151 is short, it is not necessary that the back end 111*r* of the card 101 be further inserted forward more than the back end edge 11*r* when inserting the card 101 into the card connector 1.

In addition, the portion that is at least near to the tip end of the contact arm part 51*b* and the contact part 51*c* are positioned in the opening 51*g* when viewed from above. In this manner, because the base part 51*a* and the bottom wall part 11*b* do not exist in the portion that is at least near to the tip end of the contact arm part 51*b* and the contact part 51*c*, the contact part 51*c* can elastically displaced across a wide range in the downward direction, and thus, a contact state with the rear side contact pads 151 of the inserted card 101 can be securely maintained.

Furthermore, because the rear side terminals 51 are so-called Hoop terminals and the side surface shape of the portion that includes the base part 51*a*, the contact arm support part 51*e*, and the contact arm part 51*b*, are in a substantial U shape, the length of the contact arm support part 51*e* that functions as a spring and the contact arm part 51*b*, which is to say, the spring length, becomes longer. Accordingly, because the overall spring length is long even though the length of the support arm part 51*b* is short and the contact part 51*c* can be flexibly displaced across a wide range in the vertical direction, the contact state with the rear side contact pads 151 of the card 101 inserted into the card connector 1 can be securely maintained.

Moreover, because there is a large curvature radius of the curved part 51*f* as described above and the flexibility of the curved part 51*f* can be improved, the contact part 51*c* can be flexibly displaced across a wider range in the vertical direction.

In the example illustrated in FIG. 5, a coupled belt part 51*m* that couples the left and right band shaped parts 51*n* of the base part 51*a* and the contact arm support part 51*e* (the long and thin band shaped portion that connects the outer side corner of the coupled area of the left and right band shaped parts 51*n* of the base part 51*a* and the contact arm support part 51*e* with the corner of the substantially rectangular opening 51*g*) elastically and flexibly deformed to function as a spring due to its small measurement. By this, when the contact part 51*c* is pressed downward by the rear side contact pads 151 of the inserted card 101, as illustrated in FIG. 6, the entire contact arm support part 51*e* slants relative to the base part 51*a*. In this manner, in addition to the contact arm support part 51*e* and the contact arm part 51*b*, the coupled belt part 51*m* also functions as a spring and thus, the overall spring length is longer, and the contact part 51*c* can be elastically displaced across a wider range in the vertical direction.

Note that, in this embodiment, the front side terminals 61 are not provided with a portion that corresponds to the contact arm support part 51*e* that includes a curved part 51*f*, and the portion rearward from the back end of the front side terminal holding recessed part lid of the base part 61*a* is embedded in the bottom wall part 11*b*, and the base end of the contact arm part 61*b* is coupled to the front end of the base part 61*a*. Further, the tip end of the contact arm part 61*b* is a cantilever shaped member that extends at a slant upward toward the front end edge 11*f* and is a member that functions a spring, and because a sufficient spring length can be secured, it is formed longer than the contact arm part 51*b* of the rear side terminals 51.

Next, a description will be given of the operation of the card connector 1 as configured above. First, a description will be given of an operation for inserting the card 101.

To begin with, the user inserts the card 101 by a finger or the like into the card insertion space formed between the housing 11 and the shell 71 from the rear insertion opening 18 of the card connector 1. Note that with the card 101, the front end 111*f* faces the direction of the front end edge 11*f* of the housing 11, the bottom surface 111*a* opposes the bottom wall part 11*b*, and the top surface 111*b* is inserted in a disposition so as to oppose the top panel part 72 of the shell 71. By this, the card 101 advances along the card guide mechanism housing part 11*h* by the side edge 112 where the notch 111*c* is not formed.

Next, when the user further pushes the card 101, the card 101, held by the sliding member 23, travels toward the back wall part 11*a* together with the sliding member 23 because the side edge holding part 23*b* and the front end holding part 23 of the sliding part 23 holds the side edge 112 and the front end 111*f* of the card 101. At this time, the pressing force exerted by the finger or the like of the user is transferred to the sliding member 23 via the front end holding part 23*c* from the front end 111 of the card 101. Further, because the sliding member 23 compresses the biasing member 82 made of a coil spring, the sliding member 23 and the card 101 receive the repulsive force of the biasing member 82, and because the repulsive force is smaller than the pressing force exerted by the finger or the like of the user, it travels in resistance to the repulsive force. In this case, the sliding member 23 slides along the card guide mechanism housing part 11*h*, and the card 101 advances together with a sliding member 23. Further, the sliding member 23 and the card 101 arrive at an over stroke position which is the furthest advanced position to create an over stroke state.

Continuing, when the user stops the pushing action of the card 101 and removes the pressing force against the card 101, the sliding member 23 and the card 101 are moved in a direction to disengage from the back wall part 11*a*, which is to say in a rearward direction. Further, the sliding member 23 and the card 101 stop and are held in a locked position in a state in which the card 101 is locked in the card connector 1. This is because the free end of the pin member 81 that is engaged with the cam groove 22 formed on the top surface of the slide cam part 21 stops the sliding member 23 in the locked position by stopping the movement of the sliding member 23 by latching to a portion of the cam groove 22.

Figure 7:
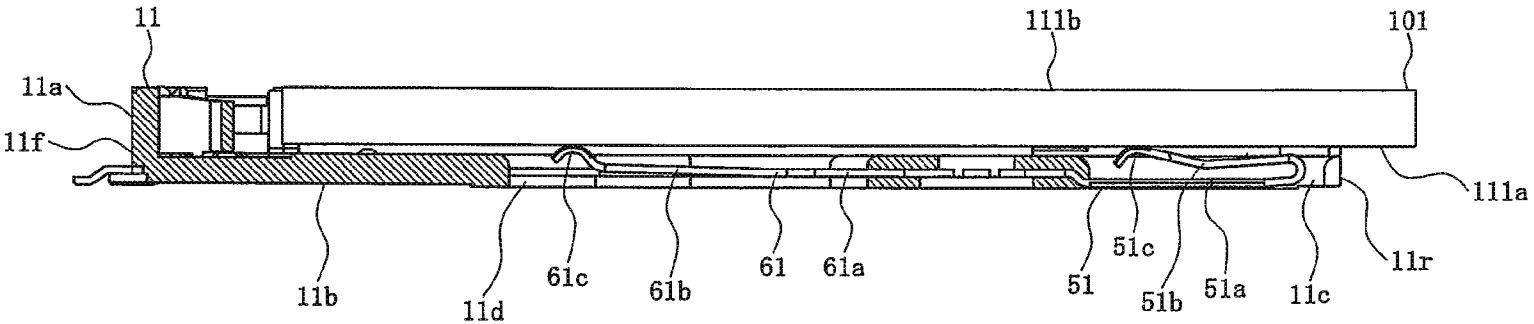
FIG. 7 is a cross-sectional side view of a state in which a card is loaded into the card connector of FIG. 1.
Figure 8:
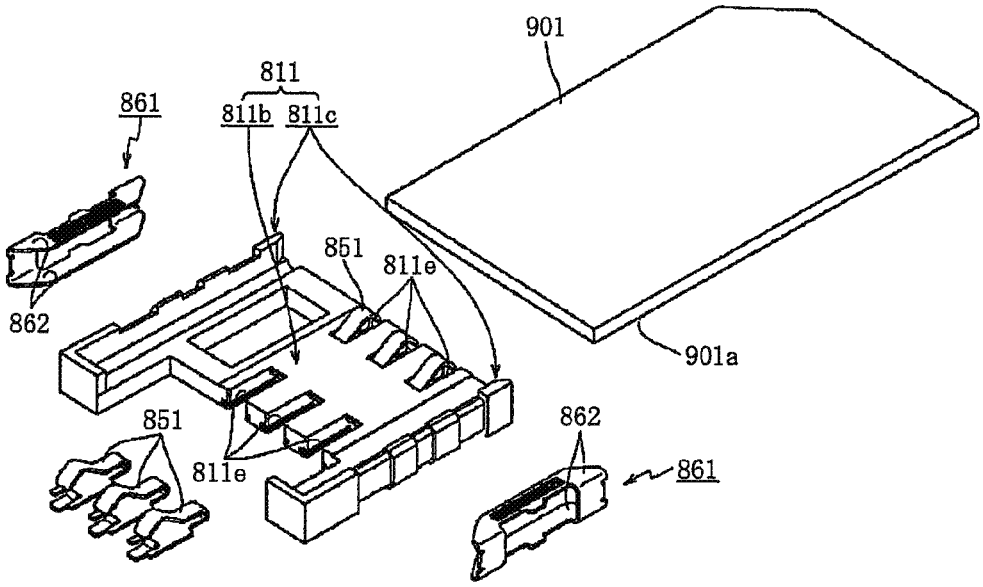
Prior art FIG. 8
FIG. 8 is a view illustrating a conventional card connector.

Further, the card 101, when held in the locked position, can send and receive data with a calculating means or the like of an electronic device in which the card connector 1 is mounted. Note that when the card 101 is held in the locked position making a state as illustrated in FIG. 7, the contact part 51*c* and the contact part 61*c* of the rear side terminals 51 and the front side terminals 61 of the card connector 1 contact and conduct with the rear side contact pads 151 and the front side contact pads 161 of the card 101. In addition, the abutting part 62*c* of the first contact point member 62 of the card detection switch is pressed forward and is displaced by the front end 111*f* of the card 101, and the main body part 62*b* separates from the contact part 63*b* of the second contact point member 63. By this, the first contact point member 62 is disconnected from the second contact point member 63 thereby turning off the card detection switch.

Incidentally, it is normal that the back end 111*r* of the card 101 is pressed by a finger or the like when the user pushes the card 101. If the bottom wall part 11*b* of the housing 11 is formed long and the front and rear direction and the position of the back end edge 11*r* is further rearward than the position of the back end 111*r* of the card 101 held in a locked position, the pushing operation becomes more difficult as the finger or the like abuts against the back end edge 11*r* of the housing 11 when the user pushes the card 101 advancing it to an over stroke position that is more forward than the locked position. In other words, the operability is reduced.

However, in the card connector 1 in this embodiment, as described above, the rearward portion of the rear side terminals 51 do not need to be indebted and fixed in the bottom wall part 11*b*, and thus, the rear side terminals 51 can be arranged in a position adjacent to the back end edge 11*r*. By this, the distance from the back end edge 11*r* to the contact part 51*c* can be shortened, and even if the distance from the back end 111*r* of the card 101 to the rear side contact pads 151 is short, it is not necessary that the back end 111*r* of the card 101 be further inserted forward more than the back end edge 11*r* when advancing the card 101 to the over stroke position. Accordingly, there is no reduction in operability.

Next, a description of the operation to eject the card 101 from the card connector 1 will be described.

To begin with, when the user pushes the card 101 by a finger or the like, the sliding member 23 and the card 101 are moved toward the back wall part 11*a* from the locked position. Further, when the user further pushes the card 101, the sliding member 23 and the card 101 arrive at the over stroke position which is the furthest advanced position thereby creating an over stroke state.

Continuing, when the user stops the pushing action of the card 101 and removes the pushing force against the card 101, the sliding member 23 and the card 101 positioned in the over stroke position are moved in a direction to disengage from the back wall part 11*b* and move in a direction opposite to the insertion direction. Further, the sliding member 23 and the card 101 pass through the locked position and further move rearward where the card 101 is ejected from the insertion opening 18.

Note that in this embodiment, a description was given in which the configuration of the front side terminals 61 differ from the configuration of the rear side terminals 51, however, the configuration of the front side terminals 61 may be the same as the configuration of the rear side terminals 51.

In addition, in this embodiment, a description was given in which the card 101 is provided with front side contact pads 161 and rear side contact pads 151, and corresponding to these, the card connector 1 provides front side terminals 61 and rear side terminals 51, however, the card 101 may not be provided with front side contact pads 161 but may provide only rear side contact pads 151, and in this case, the card connector 1 also does not provide front side terminals 61 but may provide only rear side terminals 51.

In this manner, in the present embodiment, the card connector 1 includes: a housing 11 that houses the card 101 that is provided with at least rear side contact pads 151; rear side terminals 51 that are attached to the housing 11 and which contact at least with the rear side contact pads 151 of the card 101; and a shell 71 attached to the housing 11 that covers at least the housing 11 and a portion of the card 101 inserted into the housing 11. Further, the rear side terminals 51 are arranged along the back end edge 11*r* of the housing 11, and the rear side terminals 51 are provided with a base part 51*a* in which at least a portion is embedded in a bottom wall part 11*b* of the housing 11, a contact arm part 51*b* in a cantilever shape in which a tip end extends slanted upwards towards a front end edge 11*f* of the housing 11, a contact part 51*c* that is connected to a tip end of the contact arm part 51*b* and that contacts with the rear side contact pads 151 of the card 101, and a contact arm support part 51*e* that includes a curved part 51*f* that projects rearward with a bottom side front end coupled to a back end of the base part 51*a* and a top side front end coupled to a back end of the contact arm part 51*b*.

According to this, the card connector 1 can have a high reliability, can arrange the contact part 51*c* of the tip end of the contact arm part 51*b* to be positioned near the back end edge 11*r* of the housing 11 while maintaining a sufficient length in spring length of the rear side terminals 51, and can allow a card 101 having rear side contact pads 151 arranged on the back end side to be easily inserted and ejected.

In addition, the housing 11 is provided with a rear side terminal holding recessed part 11*c* arranged along the back end edge 11*r* and that passes through the bottom wall part 11*b*, and the rear side terminals 51 are held in the rear side terminal holding recessed part 11*c* such that the contact arm part 51*b*, the contact part 51*c*, and the contact arm support part 51*e* do not abut against the bottom wall part 11*b*. According to this, because the contact arm part 51*b*, the contact part 51*c*, and the contact arm support part 51*e* can freely and elastically displace, and the contact part 51*c* can be elastically displaced across a wide range in the vertical direction, a contact state with the rear side contact pads 151 of the inserted card 101 can be securely maintained. In addition, because the rearward portion of the rear side terminals 51 do not need to be embedded and fixed to the bottom wall part 11*b*, as illustrated in FIG. 7, the rear side terminal holding recessed part 11*c* is formed so as to be near the back end edge 11*r* of the housing 11, and the rear side terminals 51 can be arranged in a position adjacent to the back end edge 11*r*. Accordingly, the distance from the back end edge 11*r* to the contact part 51*c* can be shortened, and even if the distance from the back end 111*r* of the card 101 to the rear side contact pads 151 is short, because it is not necessary that the back end 111*r* of the card 101 be further inserted forward more than the back end edge 11*r* when inserting the card 101 into the card connector 1, operability can be improved.

In addition, the rear side terminals 51 are provided with an opening 51*g* formed on the base part 51*a*, and the base part 51*a* is divided by the opening 51*g* into a pair of left and right band shaped parts 51*n* that extend in the front and rear direction, and the front ends of the band shaped parts 51*n* are coupled by an embedded bar part 51*h* in which at least a portion is embedded in the bottom wall part 11*b*, and the contact part 51*c* is positioned above the opening 51*g*. In this manner, because the embedded bar part 51*h* is embedded in the bottom wall part 11*b*, the integrity between the rear side terminals 51 and the bottom wall part 11*b* is further secured. In addition, because the base part 51*a* does not exist below the contact part 51*c*, the contact part 51*c* can elastically displaced across a wide range in the downward direction, and thus, a contact state with the rear side contact pads 151 of the inserted card 101 can be securely maintained.

In addition, the base part 51*a* includes a curved part 51*j* formed on the band shaped part 51*n*, and the back end of the base part 51*a* is positioned lower than the embedded bar part 51*h*.

According to this, because the lower side front end of the contact arm support part 51*e* can be positioned near the bottom surface of the bottom wall part 11*b* even if the embedded bar part 51*h* is set up so as to be positioned in the middle of the thickness direction of the bottom wall part 11*b*, the height position of the contact arm part 51*b* from the bottom surface of the bottom wall part 11*b* can be suppressed even with a large curvature radius of the curved part 51*f* and a wide spacing between the lower side front end of the contact arm support part 51*e* and the upper side front end, thereby enabling the low height of the card connector 1.

In addition, when the coupled belt part 51*m* that couples the base part 51*a* and the contact arm support part 51*e* elastically deforms, the entire contact arm support part 51*e* slants relative to the base part 51*a*. In this manner, in addition to the contact arm support part 51*e* and the contact arm part 51*b*, the coupled band part 51*m* also functions as a spring and thus, the overall spring length is longer, and the contact part 51*c* can be elastically displaced across a wider range in the vertical direction.

While a preferred embodiment of the Present Disclosure is shown and described, it is envisioned that those skilled in the art may devise various modifications without departing from the spirit and scope of the foregoing Description and the appended Claims.

What is claimed is:

1. A card connector, comprising:

a housing that houses a card provided with a terminal member;

a connecting terminal attached to the housing that connects with the terminal member of the card;

a cover member attached to the housing and which covers at least the housing and a portion of the card inserted in the housing;

wherein:

the connection terminal includes a rear side connection terminal arranged along the back end edge of the housing; and the rear side connection terminal is provided with a base part in which at least a portion is embedded in a bottom wall part of the housing, a contact arm part in a cantilever shape in which a tip end extends slanted upwards towards a front end edge of the housing, a contact part that is connected to a tip end of the contact arm part and that contacts with a terminal member of the card, and a contact arm support part that includes a curved part that projects rearward with a bottom side front end coupled to a back end of the base part and a top side front end coupled to a back end of the contact arm part.

2. The card connector of claim 1, wherein a coupled belt part that couples the base part and contact arm support part is elastically formed, and the entire contact arm support part is slanted relative to the base part.

3. The card connector of claim 1, wherein the rear side connection terminal is provided with an opening formed in the base part.

4. The card connector of claim 3, wherein the base part is divided by the opening into a left and right pair of band parts that extend in the front and rear direction.

5. The card connector of claim 4, wherein the front end of the band parts is coupled by an embedded bar part in which at least a portion is embedded in the bottom panel part.

6. The card connector of claim 5, wherein the contact part is positioned above the opening part.

7. The card connector of claim 1, wherein the housing is provided with a terminal holding recessed part that is arranged along the back end edge and passes through the bottom panel part.

8. The card connector of claim 7, wherein the rear side connection terminal is held within the terminal holding recessed part so that the contact arm part, contact part, and contact arm support part do not abut against the bottom panel part.

9. The card connector of claim 8, wherein a coupled belt part that couples the base part and contact arm support part is elastically formed, and the entire contact arm support part is slanted relative to the base part.

10. The card connector of claim 8, wherein the rear side connection terminal is provided with an opening formed in the base part.

11. The card connector of claim 10, wherein the base part is divided by the opening into a left and right pair of band parts that extend in the front and rear direction.

12. The card connector of claim 11, wherein the front end of the band parts is coupled by an embedded bar part in which at least a portion is embedded in the bottom panel part.

13. The card connector of claim 12, wherein the contact part is positioned above the opening part.

14. The card connector of claim 13, wherein a coupled belt part that couples the base part and contact arm support part is elastically formed, and the entire contact arm support part is slanted relative to the base part.

15. The card connector of claim 13, wherein the base part includes a folded part formed on the band part.

16. The card connector of claim 15, wherein the back end of the base part is positioned lower than the embedded bar part.

17. The card connector of claim 16, wherein a coupled belt part that couples the base part and contact arm support part is elastically formed, and the entire contact arm support part is slanted relative to the base part.

* * * * *